United States Patent [19]

Hashimoto

[11] Patent Number: 4,628,801

[45] Date of Patent: Dec. 16, 1986

[54] WIND DIRECTION CHANGING DEVICE

[75] Inventor: Yasuhiko Hashimoto, Fujieda, Japan

[73] Assignee: Mitsubishi Denki Kabushiki Kaisha, Tokyo, Japan

[21] Appl. No.: 736,849

[22] Filed: May 22, 1985

[30] Foreign Application Priority Data

May 25, 1984 [JP] Japan ..... 59-106249
Dec. 6, 1984 [JP] Japan ..... 59-258219

[51] Int. Cl.[4] ..... F24F 13/15
[52] U.S. Cl. ..... 98/40.3; 98/121.2
[58] Field of Search ..... 98/40.3, 94.2, 121.2, 98/40 V, 40 VM, 94 AC, 121 A

[56] References Cited

U.S. PATENT DOCUMENTS 3,346,007 10/1967 Agnon ..... 98/121.2
3,577,905 5/1971 Nussdorfer et al. ..... 98/94.2
3,948,154 4/1966 Asakai et al. .

FOREIGN PATENT DOCUMENTS 68745 6/1981 Japan ..... 98/40.3
59-9445 1/1984 Japan .
1043243 12/1956 United Kingdom .
1342171 12/1973 United Kingdom .
2108263 5/1983 United Kingdom ..... 98/40.3

*Primary Examiner*—Larry I. Schwartz
*Attorney, Agent, or Firm*—Oblon, Fisher, Spivak, McClelland & Maier

[57] ABSTRACT

An air conditioner is provided with a wind direction changing device of a construction, wherein one end of a connecting rod is pivotally fixed to one end of an arm of a sliding rod which performs reciprocating movement by converting the rotational movement of an electric motor, and the other end of the connecting rod is pivotally fitted in one of the holes formed in a multi-perforated plate having a plurality of holes, the plate being formed integrally with one of a plurality of wind direction changing pates which are freely oscillatable around a pivotal point as a center of oscillation thereof.

8 Claims, 14 Drawing Figures

WIND DIRECTION CHANGING DEVICE

This invention relates to a wind direction changing device (or a so-called "wind deflector") for use in an air conditioning apparatus, or the like.

FIGS. 1 to 6 of the accompanying drawing illustrates a conventional wind direction changing device and an air conditioning apparatus adopting the wind direction changing device as disclosed in, for example, an unexamined Japanese utility model publication No. 9445/1984. In these figures of drawing, a reference numeral (1) designates a main body of the air conditioning apparatus; a numeral (2) refers to a front panel; a numeral (3) refers to an inlet port, through which air in the room is sucked into the air conditioning apparatus by means of a fan (not shown in the drawing), the air as sucked into it being subjected to heat-exchange and then forwarded to a blow-off port (4) under pressure to be blown off from the air conditioning apparatus. In order that the room air subjected to heat-exchange may be uniformly blown into the room from the blow-off port (4), a blow-off louver (5), which is oscillatable in the up and down direction and is provided with shafts (6) and (7) at both sides thereof, is disposed within the blow-off port (4).

The blow-off louver (5) is provided with horizontally disposed up-and-down wind direction changing plates (8), each being provided with bosses (not shown) at both sides thereof for guiding the air as air-conditioned in both upward and downward directions. At the inner side of the up-and-down wind direction changing plates (8), there are arranged left and right wind direction changing plates (9) and (10), each being provided with bosses (not shown) at both upper and lower sides thereof in mutually opposed directions with respect to the center part of the blow-off louver 5, the plates being connected at their lower part by means of a connecting plate (12) and fitted together in the lengthwise direction. Further, an arm (11) is projectively provided on the center-most movable plate (16) of the abovementioned left and right wind direction changing plates (9) and (10), a boss (19) being provided at the distal end of the center-most movable plate (16).

An electric motor (13) having a crank (14) is fixedly provided at one end part of the blow-off louver (5), in association with which the movable plate (16) having a hole (18) is connected at the portion of a pivotal point (17) at the center part thereof, the movable plate being associated with the abovementioned electric motor (13), the crank (14) and a rod (15).

In the conventional wind direction changing device constructed as mentioned above, the upward and downward wind direction is controlled in two stages by oscillating the blow-off louver (5) per se in both upward and downward directions around the axes (6) and (7) provided at both sides of the blow-off louver (5), and moving the up-and-down wind direction changing plates (8) in both upward and downward directions.

As for the left-and-right wind direction, it is controlled in such a way that, when the crank (14) of the electric motor (13) disposed at the end part of the blow-off lourver (5) is rotated, the movable plate (16), with which the crank (14) and the rod (15) are associated, is moved in the left and right directions with the pivotal point (17) as the center to thereby perform the reciprocating movement. On the other hand, a projected piece (19) of the arm (11) protruding from the left and right wind direction changing plates (9) and (10) disposed at both sides of the movable plate (16) fits into a hole (18) of the movable plate (16). Accordingly, the reciprocating movement of the movable plate is transmitted to the left-and-right wind direction changing plates (9) and (10).

In the conventional wind direction changing device, however, the shaft of the motor 13 extends in the direction parallel to the direction of air-blowing, on account of which the motor having a relatively large diametrical dimension is arranged at the lateral side of the blow-off louver thereby increasing the dimension in the left and right direction of the device. This is opposite to the requirement that the width of the blowing port should be small when a wind direction changing device is assembled in an air conditioning apparatus having a limited outer dimension.

Further, since the conventional wind direction changing device transmits the reciprocating movement of the rod (15) to the left-and-right wind direction changing plates (9) and (10) through the movable plate (16) and the arm (11) fitted into the hole (18) of the movable plate (16), the wind direction changing angle is principally governed by a length of the movable plate (16) and the arm (11), and a position of the hole (18) with the consequence that the device has a problem in that it does not change the wind direction changing angle in accordance with the installing position of the air conditioning apparatus, etc. and a desire of the user.

SUMMARY OF THE INVENTION

The present invention has successfully solved the problem inherent in the abovementioned conventional device and aims at providing an improved wind direction changing device assembled in an air conditioning apparatus without reducing the width of a blow-off port by arranging a driving shaft of an electric motor which constitutes a driving unit for the wind direction changing device so as to be perpendicular to the direction of air-blowing and by providing a converting member for converting the rotational movement of the driving shaft into the reciprocating movement.

Further, it is an object of the present invention to provide a wind direction changing device which is capable of varying the wind direction angle depending on the position of installation of the air conditioner and the desire of the users.

According to the present invention, there is provided an air conditioner comprising a blow-off port for blowing air as air-conditioned and a wind direction changing device provided in the blow-off port to automatically change the direction of an air flow, comprising a plurality of wind direction changing plates juxtaposed to each other and pivoted in the blow-off port in a freely rotatable manner; connecting means connected to the wind direction changing plates to cause associated movement of the plates; transmitting means connected to one of the plurality of wind direction changing plates and pivoted in the blow-off port in an oscillatable manner, the oscillating movement of the transmitting means causing oscillation of the wind direction changing plates in a limited range; an electric motor disposed at the end part of the blow-off port so that the direction of a rotary shaft of the motor is substantially perpendicular to the direction of an air-flow blown from the blow-off port, and converting means connected between the rotary shaft and the transmitting means to convert the rotational motion of the rotary shaft into a reciprocating movement.

The wind direction changing device assembled in the air conditioner of the present invention is of such a construction that one end of a connecting rod is pivotally fixed to one end of an arm of a sliding rod which performs the reciprocating movement by converting the rotational movement of an electric motor, and that the other end of the connecting rod is pivotally fitted in one of the holes formed in a multi-perforated plate having a plurality of holes, the plate being integrally formed with one of a plurality of the wind direction changing plates which are freely oscillatable around a pivotal point as their center of oscillation.

BRIEF DESCRIPTION OF THE DRAWINGS

In the drawing,

FIGS. 9 to 14 illustrate another embodiment of the present invention, wherein FIGS. 9 and 10 are explanatory diagrams of a wind direction changing device;

FIG. 11 is an explanatory diagram illustrating the reciprocating motion of a sliding rod by a rotational motion of a crank, one end of the crank being fitted into a slot of the sliding rod in a freely slidable manner;

FIG. 12 is a perspective view of the sliding rod;

FIG. 13 is a cross-sectional view showing a state in which one end of a connecting rod is pivotally fixed to one end of an arm of the sliding rod and the other end of the connecting rod is pivotally fixed into a hole of a multi-perforated plate; and FIG. 14 is a modified embodiment of the connecting rod of the present invention in which one end of the connecting rod is pivotally fixed to one end of an arm of the sliding rod, and the other end of the connecting rod is pivotally fitted into one hole of a multi-perforated plate.

DESCRIPTION OF THE PREFERRED EMBODIMENTS

In the following discussion, the present invention will be described in detail with reference to the preferred embodiments thereof shown in the accompanying drawing.

Figure 1:
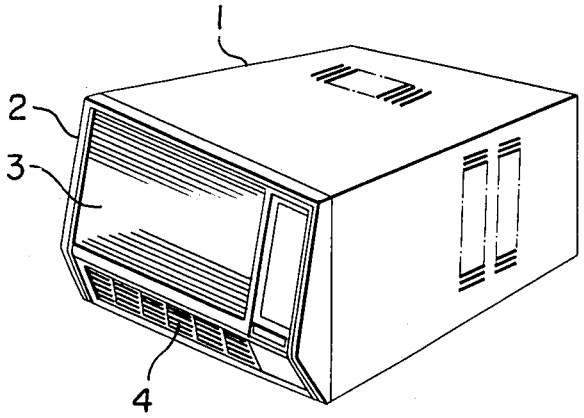
FIG. 1 is a perspective view of an air conditioning apparatus provided with a convertional wind direction changing device.
Figure 2:
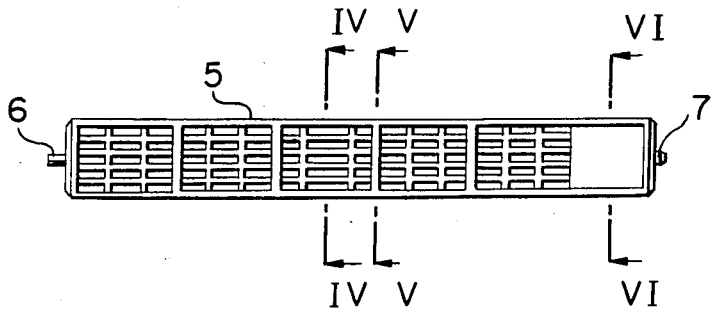
FIG. 2 is a front view showing a blow-off port of the conventional device.
Figure 3:
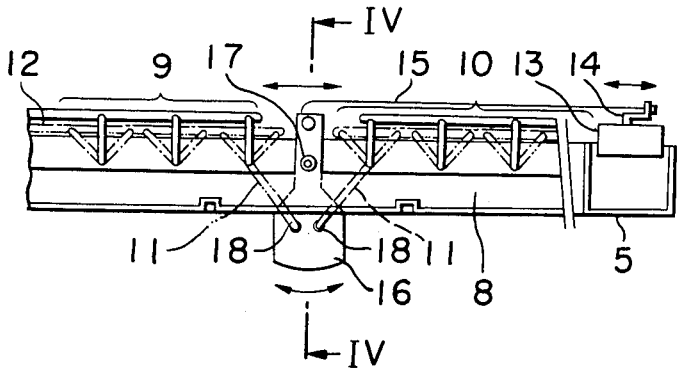
FIG. 3 is a plan view of the conventional wind direction changing device.
Figure 4:
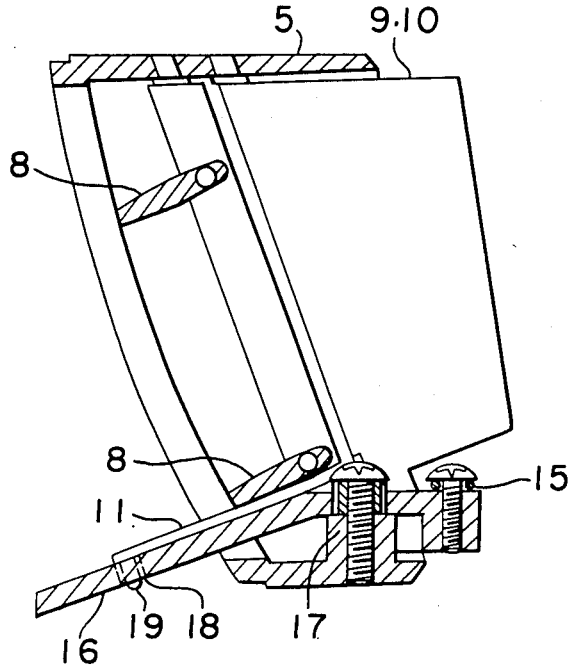
FIG. 4 is a cross-sectional view taken along a line IV—IV in FIGS. 2 and 3.
Figure 5:
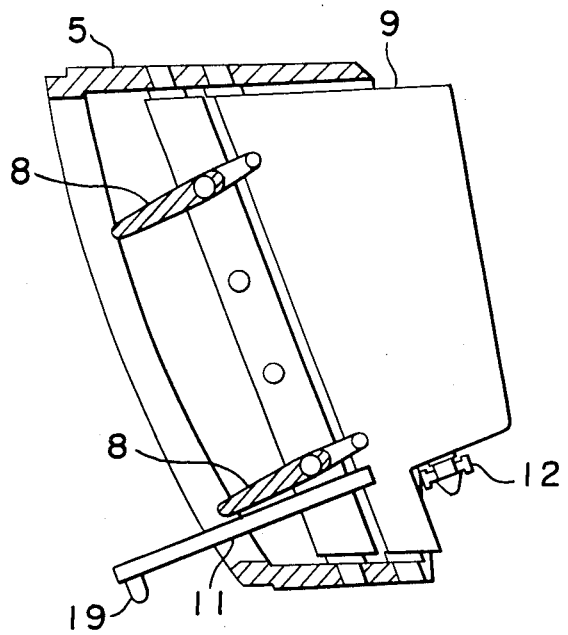
FIG. 5 and 6 are respectively cross-sectional views taken along lines V—V and VI—VI in FIG. 2.
Figure 6:
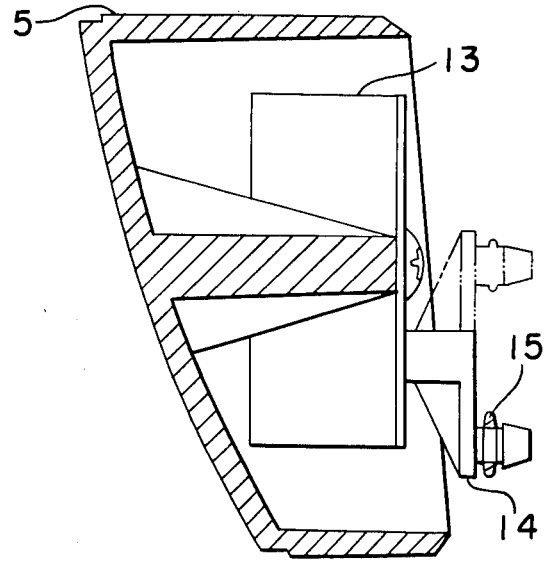
Figure 7:
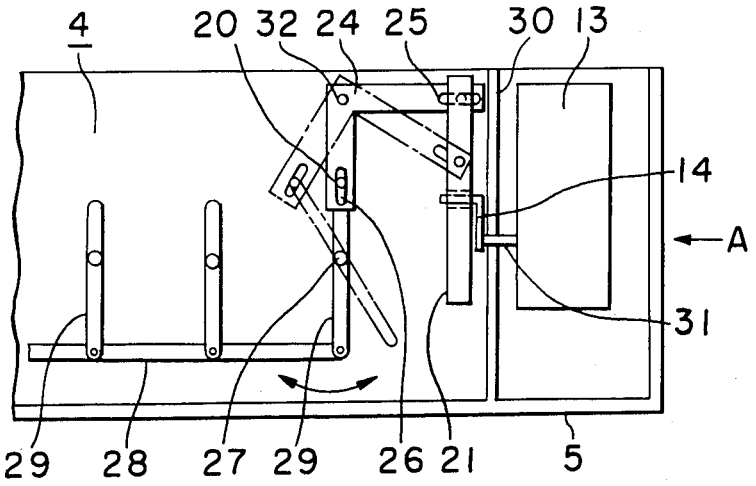
FIG. 7 is a diagram showing the operation of the wind direction changing plate according to an embodiment of the present invention.
Figure 8:
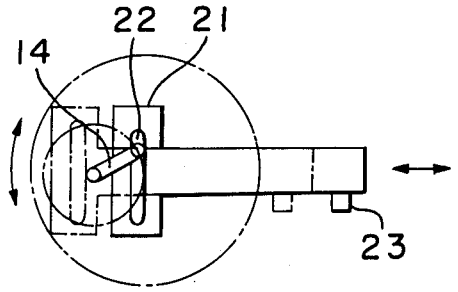
FIG. 8 is a diagram showing the operation of a sliding rod, in the view from the direction of A in FIG. 7.

FIGS. 7 and 8 illustrate an embodiment of the present invention, in which the same reference numerals as in FIGS. 1 to 6 designate the same parts and the construction of the air conditioner main body is the same as that of the conventional air conditioning apparatus. The electric motor 13 as a driving device is disposed with the drive shaft 31 extending to the side of the blow-off port 4. On the drive shaft 31, there is mounted a crank 14 as a power transmission member, whose one end is fitted in a slot 22 of a sliding rod 22 as a converting member, in a freely slidable manner. A guide (not shown) is provided so that the sliding rod 21 is slidable only in the forward and backward direction. A pin 23 as a connecting member formed on or attached to one end of the sliding rod 21 is fitted into an elongated hole 25 of an L-shaped lever 24 as a transmitting means in a freely slidable manner. At the other end of the lever 24, another elongated hole 26 is formed. A pin 20 as a connecting member which is attached at one of the wind direction changing plates 29 is fitted into the elongated hole 26 in a freely slidable manner. Each of the wind direction changing plates 29 as wind direction changing members is supported at the blow-off port 4 so as to be rotatable around a pivotal point 27. The plural wind direction changing plates 29 are connected to a connecting rod 28 as a connecting member to perform pivotal movement. A reference numeral 30 designates a partition wall and a numeral 32 designates a pivotal point.

The operation of the wind direction changing device having the abovementioned construction will be described. A torque provided by the motor 13 is converted into reciprocating movement by the crank 14 and the sliding rod 21. The reciprocating movement of the sliding rod 21 is transmitted to the wind direction changing plates 29 for generating movement of different direction since the lever 24 is subjected to the rotational movement around the pivotal point 32. With the wind direction changing plates 29 connected to the connecting rod 28, the rotational movement of the motor 13 is converted into the reciprocating movement which is transmitted to the plates 29, whereby the direction of an air flow is automatically changed by the wind direction changing plates 29.

Figure 9:
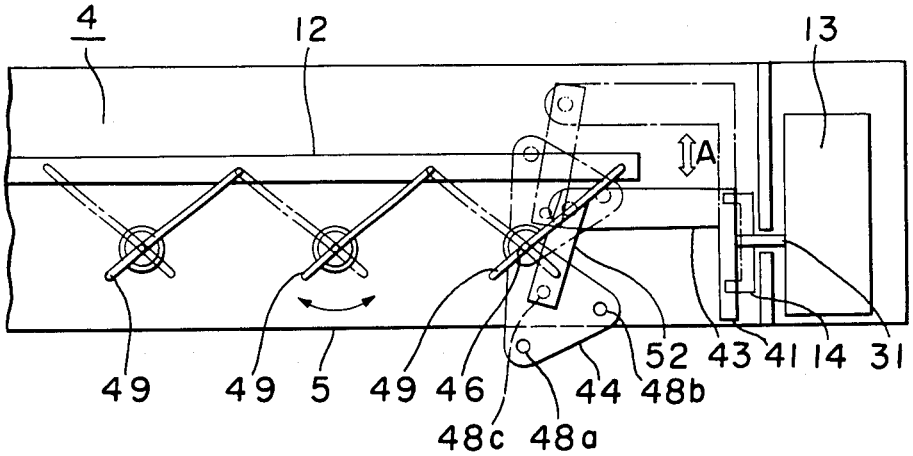
Figure 10:
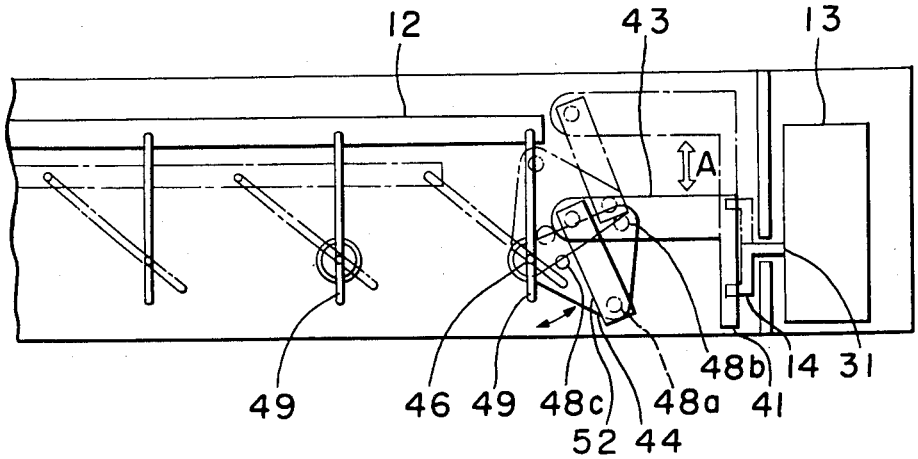
Figure 11:
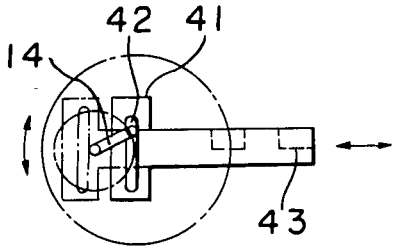
Figure 12:
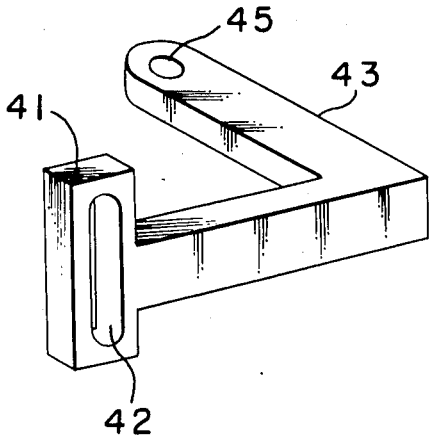
Figure 13:
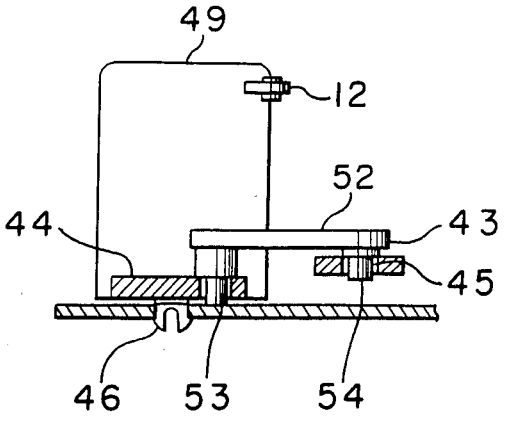

FIGS. 9 to 14 illustrate a second embodiment of the present invention, in which the reference numerals (1) to (10) designate the analogous parts to those in the conventional device, and the construction of the air conditioner main body is the same as that of the conventional air conditioning apparatus. On a drive shaft (31) of the motor (13) as the driving device, there is mounted the crank (14) as the power transmission member. One end of the crank (14) is fitted in a slot (42) of a sliding rod (41) in a freely slidable manner. On the sliding rod (41), there is mounted a guide (not shown), which is slidable in the direction of an arrow mark A as shown in FIGS. 9 and 10. Accordingly, the rotational movement of the motor (13) causes the sliding rod (41) to perform its reciprocating movement through the crank (14). One end of the sliding rod (41) has an arm (43) formed thereon, and the distal end part of the arm (43) has a hole (45) formed in it. A connecting rod (52) has pins (53), (54) provided on both end parts thereof. A plurality of wind direction changing plate (49) are utilized, each being spaced apart at a certain definite interval in the blow-off port (4). Each of the wind direction changing plates (49) is jointed together by a connecting plate (12). The wind direction changing plate (49) has its own pivotal point (46) and is freely rotatable around the pivotal point (46) as the center. A multi-perforated plate (44) having three holes **(48*a*), (48*b*) and (48*c*) is integrally formed with one of a plurality of wind direction changing plates (49). A pin (54) at one end of the connecting rod (52) is fitted into the hole (45) at the distal end part of the arm (43) to cause one end of the connecting rod (52) to be pivotally fixed to the distal end part of the arm (43). A pin (53)** at the other end of the connecting rod (52) is fitted in any one of the holes (48*a*), (48*b*) and (48*c*) in the multi-perforated plate (44) to cause the other end of the connecting rod (52) to be rotatably connected to the multi-perforated plate (44). FIG. 9 shows that the other end of the connecting rod (52) is pivotally fitted into the hole (48*c*) of the multi-perforated plate (44), which is the nearest to the pivotal point (46) of the wind direction changing plate (49), in which case the wind direction changing plate (49) oscillates to the left and the right at the largest angle. FIG. 10 shows a state in which the other end of the connecting rod (52) is pivotally fitted in the hole (48*a*) of the multi-perforated hole (44), which is the farthest from the pivotal point (46) of the wind direction changing plate (49), in which case the wind direction changing plate (49) is subjected to oscillation at a small angle only in the right region with respect to its neutral position. Moreover, when the other end of the connecting rod (52) is pivotally fitted in the hole (48*b*) of the multi-perforated plate (44), the wind direction changing plate (49) is subjected to oscillation only in the left region with respect to the neutral position.

In the following discussion, an explanation will be given as to the operations of the wind direction changing device according to the present invention. The rotational movement of the motor (13) causes the sliding rod (41) to perform its reciprocating movement by way of the crank (14). The reciprocating movement of the sliding rod (41) is transmitted to the multi-perforated plate (44) by means of the connecting rod (52), whereby the wind direction changing plates (49) becomes oscillated around the pivotal point (46) as the center. When one wind direction changing plate (49) oscillates, its motion is transmitted to the connecting plate (12), whereby a plurality of wind direction changing plates (49) become oscillated simultaneously.

It may be understood that the oscillating angle of the wind direction changing plates (49) is varied depending on which one of the holes (48*a*), (48*b*) and (48*c*) in the multi-perforated plate (44) to pivotally fit the other end of the connecting rod (52) thereon is to be selected.

Figure 14:
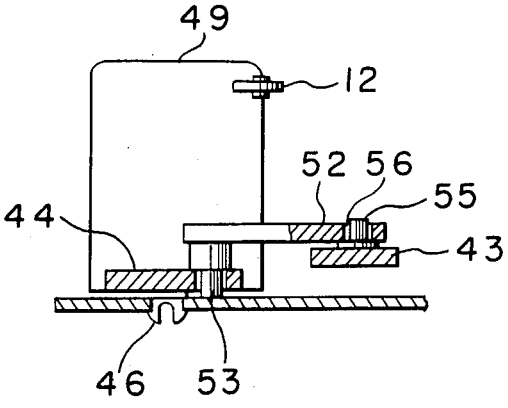

In the above-described embodiment, the pin (54) provided at one end of the connecting rod (52) is fitted in the hole (45) at the distal end part of the arm (43) to thereby pivotally fix the one end of the connecting rod (52) to the distal end part of the arm (43). However, it may be feasible that, as shown in FIG. 14, this one end of the connecting rod (52) is pivotally fixed onto the distal end of the arm (43) by providing a pin (55) at the distal end part of the arm (43) and then fitting this pin (55) into a hole (56) formed in one end part of the connecting rod (52).

Further, the multi-peforated plate (44) is not limited to having the three holes (48*a*), (48*b*) and (48*c*), and any number of the holes may serve the purpose, provided that such are a plurality.

As described above, in accordance with the present invention, a driving device for operating the wind direction changing device is arranged so that a drive shaft of the device extends toward the blow-off port. Accordingly, when the wind direction changing device is assembled in an air conditioning apparatus which is desirable to have a smaller outer dimension, there is obtainable an air conditioning apparatus with a compact structure in which a blow-off port with a sufficiently large width is formed.

I claim:

1. An air conditioner including a blow off port for blowing air as air-conditioned and a wind direction changing device provided in said blow-off port to automatically change the direction of air flow, comprising:

(a) a plurality of juxtaposed wind direction changing plates pivotably mounted in said blow-off port in a freely rotatable manner, (b) means connected to said wind direction changing plates for causing associated movement of said plates, (c) transmitting means connected to one of said plurality of wind direction changing plates and pivotably mounted in said blow-off port in an oscillatable manner wherein oscillating movement of said transmitting means causes oscillation of said wind direction changing plates in a limited range, (d) a motor disposed at an end part of said blow-off port and having a rotary shaft such that the direction of a longitudinal axis of said rotary shaft is substantially perpendicular to the direction of an air-flow from said blow-off port, and (e) means connected between said rotary shaft and said transmitting means for converting rotational motion of said rotary shaft into a reciprocating movement and which further comprises a sliding rod having a slot formed therein and a crank member having a first end thereof positioned in said slot and having a second end connected to said rotary shaft wherein said transmitting means further comprises an L-shaped member, said L-shaped member having a corner portion pivoted in a freely rotatable manner and opposite end portions thereof being respectively connected to said wind direction changing plate and said means for converting rotational motion.

2. The air conditioner according to claim 1, wherein the outer configuration of said motor is such that the dimension of said motor in the direction along said rotary shaft is smaller than that in the direction perpendicular to said rotary shaft.

3. The air conditioner according to claim 1, wherein said transmitting means is connected to a wind direction changing plate positioned at the outermost side of said blow-off port among said plurality of wind direction changing plates.

4. The air conditioner according to claim 1, wherein said transmitting means is provided with a plurality of engaging parts to selectively change a position of engagement with said converting means and to change a range of rotational movement of said transmitting means itself so that a range of rotational movement of said wind direction changing plates is adjusted by changing the position of engagement.

5. An air conditioner including a blow-off port for blowing air as air-conditioned and a wind direction changing device provided in said blow-off port to automatically change the direction of an air flow, comprising:

(a) a plurality of juxtaposed wind direction changing plates pivotably mounted in said blow-off port in a freely rotatable manner, (b) means connected to said wind direction changing plates for causing associated movement of said plates, (c) transmitting means connected to one of said plurality of wind direction changing plates and pivotably mounted in said blow-off port in an oscillatable manner wherein oscillating movement of said transmitting means causes oscillation of said wind direction changing plates in a limited range, (d) a motor disposed at an end part of said blow-off port and having a rotary shaft such that the direction of a longitudinal axis of said rotary shaft is substantially perpendicular to the direction of an air-flow from said blow-off port, and (e) means connected between said rotary shaft and said transmitting means for converting rotational motion of said rotary shaft into a reciprocating movement wherein said transmitting means is provided with a plurality of engaging parts to selectively change a position of engagement of said converting means and to change a range of rotational movement of said transmitting means itself so that a range of rotational movement of said wind direction changing plates is adjusted by changing the position of engagement and wherein said plurality of parts further comprise first, second and third engaging parts in said transmitting means so that said wind direction changing plates are subjected to rotational movement only in a predetermined region with respect to a neutral position or only in a range of a first region or in the region of said first and a second region wherein said transmitting means further comprises a triangle plate member secured to one of said wind direction changing plates at a first triangle point thereof and wherein said plate member includes a first engaging part in the vicinity of the secured portion and a second engaging part at each of second and third points of said triangular plate member wherein said converting means further comprises an L-shaped member, a first side portion of said L-shaped member being connected to said electric motor at a second side portion being connected to said transmitting member through a connecting member which is freely rotatable with respect to said second side portion and said transmitting means.

6. An air conditioner including a blow-off port for blowing air as air-conditioned and a wind direction changing device provided in said blow-off port to automatically change the direction of an air flow, comprising:

(a) a plurality of juxtaposed wind direction changing plates pivotably mounted in said blow-off port in a freely rotatably manner, (b) means connected to said wind direction changing plates for causing associated movement of said plates, (c) transmitting means connected to one of said plurality of wind direction changing plates and pivotably mounted in said blow-off port in an oscillatable manner wherein oscillating movement of said transmitting means causes oscillation of said wind direction changing plates in a limited range, (d) a motor disposed at an end part of said blow-off port and having a rotary shaft such that the direction of a longitudinal axis of said rotary shaft is substantially perpendicular to the direction of an air-flow from said blow-off port, and (e) means connected between said rotary shaft and said transmitting means for converting rotational motion of said rotary shaft into a reciprocating movement wherein said converting means further comprises a rod member subjected to reciprocating movement in a direction perpendicular to said rotary shaft and wherein said transmitting means further comprising an L-shaped member, said L-shaped member having a corner portion pivoted in a freely rotatable manner and opposite end portions thereof being respectively connected to said wind direction changing plate and said means for converting rotational motion.

7. The air conditioner according to claim 6, wherein elongated holes are respectively formed in the opposite end portion of said L-shaped member and further comprising first and second projections respectively provided in said wind direction changing plate and said means for converting rotational motion so as to slidably engaged in said elongated holes.

8. An air conditioner including a blow-off port for blowing air as air-conditioned and a wind direction changing device provided in said blow-off port to automatically change the direction of an air flow, comprising:

(a) a plurality of juxtaposed wind direction changing plates pivotably mounted in said blow-off port in a freely rotatable manner, (b) means connected to said wind direction changing plates for causing associated movement of said plates, (c) transmitting means connected to one of said plurality of wind direction changing plates and pivotably mounted in said blow-off port in an oscillatable manner wherein oscillating movement of said transmitting means causes oscillation of said wind direction changing plates in a limited range, (d) a motor disposed at an end part of said blow-off port and having a rotary shaft that the direction of a longitudinal axis of said rotary shaft is substantially perpendicular to the direction of an air-flow from said blow-off port, and (e) means connected between said rotary shaft and said transmitting means for converting rotational motion of said rotary shaft into a reciprocating movement wherein said transmitting means is provided with a plurality of engaging parts to selectively change a position of engagement of said converting means and to change a range of rotational movement of said transmitting means itself so that a range of rotational movement of said wind direction changing plates is adjusted by changing the position of engagement wherein said converting means further comprises an L-shaped member, a first side portion of said L-shaped member being connected to said electric motor and a second side portion being connected to said transmitting member through a connecting member which is freely rotatable with respect to said second side portion and said transmitting means.

* * * * *